US011702726B2

(12) United States Patent
Toda et al.

(10) Patent No.: US 11,702,726 B2
(45) **Date of Patent: *Jul. 18, 2023**

(54) HOT STAMPED ARTICLE

(71) Applicant: NIPPON STEEL CORPORATION, Tokyo (JP)

(72) Inventors: Yuri Toda, Tokyo (JP); Kazuo Hikida, Tokyo (JP); Shingo Fujinaka, Tokyo (JP); Tomohito Tanaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 96 days.

This patent is subject to a terminal disclaimer.

(21) Appl. No.: 16/976,433

(22) PCT Filed: Mar. 29, 2018

(86) PCT No.: PCT/JP2018/013372
§ 371 (c)(1),
(2) Date: Aug. 27, 2020

(87) PCT Pub. No.: WO2019/186931
PCT Pub. Date: Oct. 3, 2019

(65) Prior Publication Data

US 2021/0040592 A1 Feb. 11, 2021

(51) Int. Cl.
*C22C 38/58* (2006.01)
*C22C 38/00* (2006.01)
(Continued)

(52) U.S. Cl.
CPC ..... *C22C 38/58* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/48* (2013.01);
(Continued)

(58) Field of Classification Search
CPC ..... C22C 38/001; C22C 38/002; C22C 38/02; C22C 38/04; C22C 38/06; C22C 38/44; C22C 38/48; C22C 38/50; C22C 38/54; C21D 2211/001; C21D 2211/008
USPC ..... 428/544
See application file for complete search history.

(56) References Cited

U.S. PATENT DOCUMENTS

2013/0095347 A1 4/2013 Kawasaki et al.
2017/0096724 A1 4/2017 Hikida et al.

FOREIGN PATENT DOCUMENTS

JP 2002-309345 A 10/2002
JP 2010-174282 A 8/2010
(Continued)

*Primary Examiner* — Adam Krupicka
*Assistant Examiner* — Katherine A Christy
(74) *Attorney, Agent, or Firm* — Birch, Stewart, Kolasch & Birch, LLP

(57) ABSTRACT

A hot stamped article having excellent shock absorption having a predetermined chemical composition, having a microstructure containing prior austenite having an average grain size of 3 μm or less and further containing at least one of lower bainite, martensite, and tempered martensite in an area ratio of 90% or more, and having a grain boundary solid solution ratio Z defined by Z=(mass % of one or both of Nb and Mo at grain boundaries)/(mass % of one or both of Nb and Mo at time of melting) of 0.3 or more.

2 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C21D 6/00*** | (2006.01) |
| ***C21D 8/02*** | (2006.01) |
| ***C21D 9/46*** | (2006.01) |

(52) U.S. Cl.

CPC ..... *C22C 38/50* (2013.01); *C22C 38/54* (2013.01); *C21D 2211/001* (2013.01); *C21D 2211/002* (2013.01); *C21D 2211/008* (2013.01)

(56) References Cited

FOREIGN PATENT DOCUMENTS

| | | | |
|---|---|---|---|
| JP | 5114691 | B2 | 12/2013 |
| JP | 5369714 | B2 | 12/2013 |
| JP | 2014-15638 | A | 1/2014 |
| WO | WO 2015/147216 | A1 | 10/2015 |

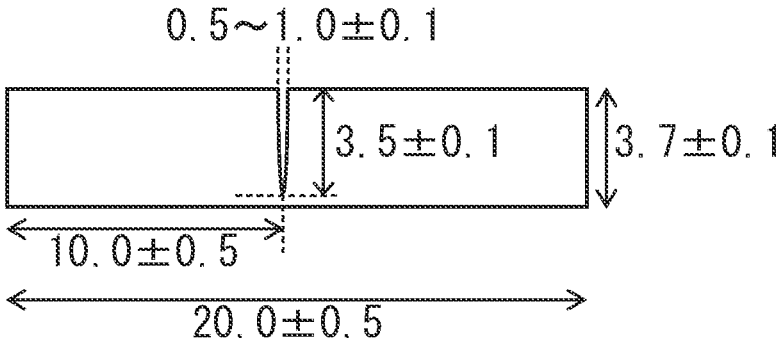
0.5～1.0±0.1
3.5±0.1
3.7±0.1
10.0±0.5
20.0±0.5

HOT STAMPED ARTICLE

FIELD

The present invention relates to a hot stamped article used for structural members or reinforcing members of automobiles or structures where strength is required, in particular excellent in shock absorption.

BACKGROUND

In recent years, from the viewpoints of environmental protection and resource saving, lighter weight of automobile bodies is being sought. For this reason, application of high strength steel sheet to automobile members has been accelerating. However, along with the increase in strength of steel sheets, the formability deteriorates, so in high strength steel sheets, formability into members with complicated shapes is a problem.

To solve this problem, hot stamping, where the steel sheet is heated to a high temperature of the austenite region, then press formed, is increasingly being applied. Hot stamping performs press forming and simultaneously quenching in the die, so is being taken note of as a technique achieving both formation of a material into an automobile member and securing strength.

On the other hand, a part obtained by shaping high strength steel sheet by hot stamping is required to exhibit performance absorbing impact at the time of collision.

As art answering this demand, PTL 1 discloses the art of annealing a steel sheet for hot stamping use and making Mn or Cr concentrate in carbides to form difficult to melt carbides and thereby suppress growth of austenite and render it finer by these carbides at the time of heating for hot stamping.

PTL 2 discloses the art of making austenite finer by raising the temperature by a 90° C./s or less heating rate at the time of heating for hot stamping.

PTL 3, PTL 4, and PTL 5 also disclose art for making the austenite finer to improve the toughness.

CITATION LIST

Patent Literature

[PTL 1] WO2015/147216

[PTL 2] Japanese Patent No. 5369714

[PTL 3] Japanese Patent No. 5114691

[PTL 4] Japanese Unexamined Patent Publication No. 2014-15638

[PTL 5] Japanese Unexamined Patent Publication No. 2002-309345

SUMMARY

Technical Problem

However, in the arts disclosed in the above PTLs 1 to 5, it is difficult to obtain further refined austenite. A shock absorption higher than the conventional level cannot be expected to be obtained.

The present invention, in consideration of the technical problem in the prior art, has as its technical problem to secure a better shock absorption in a hot stamped article of a high strength steel sheet and has as its object the provision of a hot stamped article solving this technical problem.

Solution to Problem

The inventors engaged in intensive studies on a method for solving this technical problem. As a result, they discovered that by making the average grain size of the prior austenite 3 μm or less and further making one or both of Nb and Mo form a solid solution at the prior austenite grain boundaries to raise the brittle strength of the grain boundaries, a shock absorption better than in the past was obtained.

The present invention was made after further study based on the above finding and has as its gist the following:

(1) A hot stamped article, a chemical composition of the hot stamped article comprising, by mass %, C: 0.15% to less than 0.35%, Si: 0.005% to 0.25%, Mn: 0.5% to 3.0%, sol. Al: 0.0002% to 3.0%, Cr: 0.05% to 1.00%, B: 0.0005% to 0.010%, Nb: 0.01% to 0.15%, Mo: 0.005% to 1.00%, Ti: 0% to 0.15%, Ni: 0% to 3.00%, P: 0.10% or less, S: 0.10% or less, N: 0.010% or less, and a balance of Fe and unavoidable impurities, a microstructure of the hot stamped article comprising prior austenite having an average grain size of 3 μm or less and further containing at least one of lower bainite, martensite, and tempered martensite in an area ratio of 90% or more, and a grain boundary solid solution ratio Z defined by Z=(mass % of one or both of Nb and Mo at grain boundaries)/(mass % of one or both of Nb and Mo at time of melting) being 0.3 or more.

(2) The hot stamped article according to (1), wherein the hot stamped article comprises a plating layer.

Advantageous Effects of Invention

According to the present invention, it is possible to provide a hot stamped article which is high in strength while having better shock absorption than the past.

BRIEF DESCRIPTION OF DRAWINGS

FIG. 1 is a view showing the shape of a test piece when measuring a grain boundary solid solution ratio.

DESCRIPTION OF EMBODIMENTS

The present invention is characterized by making the average grain size of the prior austenite 3 μm or less and further making one or both of Nb and Mo form a solid solution at the prior austenite grain boundaries to make the brittle strength of the grain boundaries rise. The inventors engaged in intensive studies and as a result discovered that the above microstructure is obtained by the following method.

As a first stage, the amount of casting of the molten steel per unit time is controlled. Due to this, microsegregation of Mn in the steel slab is suppressed and, further, precipitation of Mo and Nb is suppressed and the amounts of solid solution formed by the Mo and Nb in the steel are made to increase.

If controlling the amount of molten steel cast per unit time to decrease the microsegregation of Mn, the trap sites of P are consumed, so P segregates at the prior austenite grain boundaries at the time of finish rolling. This being so, despite the prior austenite grain boundaries having been made finer, a drop in the brittle strength of the grain boundaries is caused and a shock absorption cannot sufficiently be obtained. This is because Mn and P are high in affinity, so segregated Mn functions as trap sites for P and elimination of segregation causes P to disperse at the prior austenite grain boundaries. In the present invention, this technical problem is solved by a second stage of control of the rolling conditions.

As the second stage, the rolling reduction and temperature of the hot finish rolling, the cooling temperature after rolling, and the coiling temperature are controlled to thereby keep Mn from concentrating in the carbides and cause formation of easy to melt fine carbides and further introduce a high density dislocations into the steel. In the present invention, both the finely dispersed carbides and high density dislocations form sites for reverse transformation of austenite whereby the prior austenite grains are refined. To make them effectively function as reverse transformation sites, the carbides are desirably easy to melt. For this reason, it is important not to allow elements inhibiting melting of carbides of Mn, Cr, etc. to concentrate at the carbides.

Further, by suppressing the precipitation of Mo and Nb and causing Nb and Mo to form solid solutions at the grain boundaries of the prior austenite, the precipitation sites of P can be occupied by Nb and Mo and segregation of P at the prior austenite can be eliminated. Due to this, not only is the boundary strength improved by the Mo or Nb, but also reduction of the brittle strength of the grain boundaries can be suppressed.

As a third stage, the rate of temperature rise at the time of heating for hot stamping is controlled to thereby make both the easy to melt fine carbides and high density dislocations form nucleation sites for prior austenite. Due to this, the average grain size of the prior austenite in the hot stamped article can be controlled to 3 μm or less.

Further, the precipitation of NbC and MoC during heating is suppressed and the solid solution ratio of one or both of Nb and Mo at the grain boundaries of the prior austenite is made to increase. To suppress the precipitation of Mo and Nb, it is necessary to make the rate of temperature rise at the time of heating for hot stamping 100° C./s or more.

The shock absorption can be evaluated by the brittle fracture ratio in a Charpy impact test. Differences in the brittle fracture ratio are due to differences in the boundary strength. The boundary strength is determined by the microstructure (martensite, tempered martensite, lower bainite, etc.) or type of the part, the average grain size of the prior austenite, and the concentration of elements such as Nb and Mo forming solid solutions at the grain boundaries.

By raising the amounts of solid solution of Nb and Mo formed at the grain boundaries, it is possible to raise the boundary strength, but Nb and Mo easily bond with C in the steel to form carbides at 500° C. or more temperature, so it is necessary to integrally control the production process from continuous casting to hot rolling and hot pressing so as to keep these elements from precipitating. That is, to raise the amounts of grain boundary solid solution of Nb and Mo, it is necessary to satisfy the following conditions at all stages from the above-mentioned first stage to third stage.

Below, the hot stamped article of the present invention and the method for manufacturing the same will be explained in detail.

First, the reasons for limiting the chemical composition of the hot stamped article according to the present invention will be explained. Below, the % according to the chemical composition means mass %.

"C: 0.15% to Less than 0.35%"

C is an important element for obtaining a 1500 MPa or more tensile strength. With less than 0.15%, the martensite becomes soft and it is difficult to secure 1500 MPa or more tensile strength, so C is made 0.15% or more. Preferably it is 0.20% or more. On the other hand, considering the balance of the shock absorption and strength demanded, it is made less than 0.35%. Preferably, the content is less than 0.34%.

"Si: 0.005% to 0.25%"

Si is an element raising the deformability and contributing to improvement of the shock absorption. If less than 0.005%, the deformability is poor and the shock absorption deteriorates, so 0.005% or more is added. Preferably the content is 0.01% or more. On the other hand, if over 0.25%, the amount of solid solution formed in the carbides increases, the carbides become difficult to melt, and the average grain size of the prior austenite can no longer be controlled to 3 μm, so the upper limit is made 0.25%. Preferably the content is 0.22% or less.

"Mn: 0.5% to 3.0%"

Mn is an element contributing to improvement of strength by solution strengthening. If less than 0.5%, the solution strengthening ability is poor, the martensite becomes softer, and it is difficult to secure a 1500 MPa or more tensile strength, so 0.5% or more is added. Preferably the content is 0.7% or more. On the other hand, if adding over 3.0%, the amount of solid solution formed in the carbides increases, the carbides become difficult to melt, and the average grain size of the prior austenite can no longer be controlled to 3 μm or less, so 3.0% is made the upper limit. Preferably, the content is 2.5% or less.

"Sol. Al: 0.0002% to 3.0%"

Al is an element acting to deoxidize the molten steel and make the steel sounder. If less than 0.0002%, the deoxidation is sufficient and coarse oxides are formed causing early fracture, so the sol. Al is made 0.0002% or more. Preferably, the content is 0.0010% or more. On the other hand, if adding over 3.0%, coarse oxides are formed and the toughness is impaired, so the content is made 3.0% or less. Preferably, the content is 2.5% or less, more preferably it is 0.5% or less.

"Cr: 0.05% to 1.00%"

Cr is an element contributing to improvement of strength by solution strengthening. If less than 0.05%, the solution strengthening ability is poor, the martensite becomes softer, and it is difficult to secure a 1500 MPa or more tensile strength, so the content is made 0.05% or more. Preferably the content is 0.1% or more. On the other hand, if adding over 1.00%, the amount of solid solution formed at the carbides increases, the carbides become difficult to melt, and the grain size of the prior austenite can no longer be controlled to 3 μm or less, so 1.00% is made the upper limit. Preferably the content is 0.8% or less.

"B: 0.0005% to 0.010%"

B is an element contributing to improvement of strength by solution strengthening. If less than 0.0005%, the solution strengthening ability is poor, the martensite becomes softer, and it is difficult to secure a 1500 MPa or more tensile strength, so 0.0005% or more is added. Preferably the content is 0.0008% or more. On the other hand, if adding over 0.010%, the amount of solid solution formed at the carbides increases, the carbides become difficult to melt, and the average grain size of the prior austenite can no longer be controlled to 3 μm or less, so 0.010% is made the upper limit. Preferably the content is 0.007% or less.

"Nb: 0.01% to 0.15%"

Nb is an element forming a solid solution at the grain boundaries of the prior austenite and raising the strength of the grain boundaries. Further, Nb forms a solid solution at the grain boundaries to inhibit the grain boundary segregation of P, so improves the brittle strength of the grain boundaries. For this reason, 0.01% or more is added. Preferably the content is 0.030% or more. On the other hand, if adding over 0.15%, it easily precipitates as carbides and the amount of solid solution formed at the grain boundaries ends up decreasing, so the content is made 0.15% or less. Preferably the content is 0.12% or less.

"Mo: 0.005% to 1.00%"

Mo is an element forming a solid solution at the grain boundaries of the prior austenite and raising the strength of the grain boundaries. Further, Mo forms a solid solution at the grain boundaries to inhibit the grain boundary segregation of P, so improves the brittle strength of the grain boundaries. For this reason, 0.005% or more is added. Preferably the content is 0.030% or more. On the other hand, if adding over 1.00%, it easily precipitates as carbides and the amount of solid solution formed at the grain boundaries ends up decreasing, so the content is made 1.00% or less. Preferably the content is 0.80% or less.

"Ti: 0% to 0.15%"

Ti is not an essential element, but is an element contributing to improvement of strength by solution strengthening, so may be added as required. If adding Ti, to obtain the effect of addition, the content is preferably made 0.01% or more. Preferably the content is 0.02%. On the other hand, if adding over 0.15%, coarse carbides and nitrides are formed causing early fracture, so the content is made 0.15% or less. Preferably the content is 0.12% or less.

"Ni: 0% to 3.00%"

Ni is not an essential element, but is an element contributing to improvement of strength by solution strengthening, so may be added as required. If adding Ni, to obtain the effect of addition, the content is preferably made 0.01% or more. Preferably the content is 0.02%. On the other hand, if adding over 3.00%, the steel becomes brittle and early fracture is caused, so the content is made 3.00% or less. Preferably the content is 2.00% or less.

"P: 0.10% or Less"

P is an impurity element. It is an element which easily segregates at the grain boundaries and causes a drop in the brittle strength of the grain boundaries. If over 0.10%, the brittle strength of the grain boundaries remarkably falls and early fracture is caused, so P is made 0.10% or less. Preferably the content is 0.050% or less. The lower limit is not particularly prescribed, but if decreased to less than 0.0001%, the dephosphorization cost greatly rises and the result becomes economically disadvantageous, so in practical steel sheet, 0.0001% is the substantive lower limit.

"S: 0.10% or Less"

S is an impurity element. It is an element which forms inclusions. If over 0.10%, inclusions are formed and cause early fracture, so S is made 0.10% or less. Preferably the content is 0.0050% or less. The lower limit is not particularly prescribed, but if decreasing this to less than 0.0015%, the desulfurization cost greatly rises and the result becomes economically disadvantageous, so in practical steel sheet, 0.0015% is the substantive lower limit.

"N: 0.010% or Less"

N is an impurity element. It forms nitrides to cause early fracture, so the content is made 0.010% or less. Preferably the content is 0.0075% or less. The lower limit is not particularly prescribed, but if decreasing this to less than 0.0001%, the denitridation cost greatly rises and the result becomes economically disadvantageous, so in practical steel sheet, 0.0001% is the substantive lower limit.

The balance of the chemical composition consists of Fe and impurities. As the impurities, elements which unavoidably enter from the steel raw materials or scrap and/or in the steelmaking process and are allowed in a range not obstructing the properties of the hot stamped article of the present invention may be illustrated.

Next, the reasons for limitation of the microstructure of the hot stamped article of the present invention will be explained.

"Average Grain Size of Prior Austenite of 3.0 μm or Less"

The average grain size of the prior austenite is an important structural factor for securing excellent strength and the effect of suppression of early fracture. According to the studies of the inventors, to obtain the shock absorption demanded from a hot stamped article, the grain size of the prior austenite is preferably as small as possible. The average grain size has to be controlled to 3.0 μm or less. More preferably, the content is less than 2.7 μm, but the lower limit is not particularly prescribed. In current actual operation, it is difficult to make the content less than 0.5 μm, so 0.5 μm is the substantive lower limit.

The average grain size of the prior austenite is measured as follows.

First, the hot stamped article is heat treated at 540° C. for 24 hr. Due to this, corrosion of the prior austenite grain boundaries is promoted. The heat treatment may be performed by furnace heating or ohmic heating. The rate of temperature rise is made 0.1 to 100° C./s and the cooling rate is made 0.1 to 150° C./s.

A cross-section vertical to the sheet surface is cut from the center part of the hot stamped article after heat treatment. #600 to #1500 silicon carbide paper is used to polish the measurement surface, then particle size 1 to 6 μm diamond powder dispersed in alcohol or another diluent or pure water is used to polish the surface to a mirror finish.

Next, the observed surface is immersed in a 3 to 4% sulfuric acid-alcohol (or water) solution for 1 minute to bring out the prior austenite grain boundaries. At this time, the corrosion work is performed inside an exhaust treatment apparatus. The temperature of the work atmosphere is made ordinary temperature.

The corroded sample is washed by acetone or ethyl alcohol, then allowed to dry and used for observation under a scanning electron microscope. The scanning electron microscope used is equipped with two electron detectors.

In a $9.6\times10^{-5}$ or less vacuum, the sample was irradiated with electron beams at an acceleration voltage of 15 kV and level of irradiation current of 13, and a secondary electron image in a range of the ⅛ to ⅜ position about the ¼ position of sheet thickness of the sample is captured. The capture magnification is made 4000× based on a horizontal 386 mm×vertical 290 mm screen. The number of fields captured is made 10 fields or more.

In the captured secondary electron image, the prior austenite grain boundaries are captured as bright contrast. In the prior austenite grains contained in an observed field, the average value of the shortest diameter and longest diameter are calculated to obtain the average grain size. Leaving aside the prior austenite grains at the end parts of the captured field and other grains which are not completely contained in the captured field, the above operation is performed for all of the prior austenite grains to find the average grain size in the captured field. The average grain size is the value obtained by dividing the sum of the grain sizes calculated by the total number of prior austenite grains measured for grain size. This operation is performed for each of all of the fields captured to calculate average grain size of the prior austenite.

"Grain Boundary Solid Solution Ratio Z Defined by Formula (1) of 0.3 or More"

$$Z=(\text{mass \% of one or both of Nb and Mo at grain boundaries})/(\text{mass \% of one or both of Nb and Mo at time of melting}) \quad (1)$$

The grain boundary solid solution ratio Z defined by the above formula (1) is an important structural factor in securing excellent shock absorption and is a parameter which the inventors used to evaluate the shock absorption. If Nb and/or Mo forms a solid solution at the grain boundaries, it becomes harder for P to segregate at the grain boundaries and the binding force of the grain boundaries becomes higher, so the brittle strength of the grain boundaries rises and the shock absorption is improved. If the grain boundary solid solution ratio Z is less than 0.3, the grain boundary strengthening effect of Nb and/or Mo is not sufficiently obtained and the required shock absorption cannot be obtained, so the grain boundary solid solution ratio Z is made 0.3 or more. Preferably the ratio is 0.4 or more. The upper limit is not particularly prescribed, but theoretically 1.0 becomes the upper limit.

The grain boundary solid solution ratio Z is measured as follows:

From the center part of the hot stamped article, a test piece of the dimensions shown in FIG. 1 is prepared. At that time, the front and back surfaces of the test piece are mechanically ground to remove equal amounts so that the sheet thickness becomes 1.2 mm. The cut at the center part of the test piece is made by a thickness 1 mm wire cutter. The connecting part at the bottom of the cut is controlled to 100 μm to 200 μm.

Next, the test piece is immersed in a 20%-ammonium thiocyanate solution for 72 to 120 hr.

Within 0.5 hr after the end of immersion, the front and back surfaces of the test piece are galvanized.

Within 1.5 hr after plating, the sample is used for Auger electron emission spectroscopy. The type of the apparatus for performing the Auger electron emission spectroscopy is not particularly limited. The test piece is set inside the analysis apparatus and is broken from the cut part of the test piece in a $9.6\times10^{-5}$ or less vacuum to expose the prior austenite grain boundaries. The exposed prior austenite grain boundaries are irradiated with electron beams at a 1 to 30 kV acceleration voltage and the mass % (concentration) of the Nb and/or Mo at the grain boundaries is measured. The measurement is performed at the prior austenite grain boundaries at 10 or more locations. To prevent contamination of the grain boundaries, the measurements are completed within 30 minutes after the break.

The average value of the mass % (concentration) of the obtained Nb and/or Mo is calculated. The value divided by the mass % of the added Nb and/or Mo is made the grain boundary solid solution ratio Z.

"90% or More of Microstructure by Area Ratio Comprised of One or More of Lower Bainite, Martensite, and Tempered Martensite"

In order for the hot stamped article to be given a 1500 MPa or more tensile strength, the microstructure has to include, by area ratio, 90% or more of martensite or tempered martensite. Preferably, the ratio is 94% or more. From the viewpoint of securing tensile strength, the microstructure may also be lower bainite. 90% or more of the structure by area ratio may also be one of lower bainite, martensite, and tempered martensite or may be a mixed structure of the same.

The balance of the microstructure is not particularly prescribed. For example, upper bainite, residual austenite, and pearlite may be mentioned.

The area ratios of the lower bainite, martensite, and tempered martensite are measured as follows:

A cross-section vertical to the sheet surface is cut from the center part of the hot stamped article. #600 to #1500 silicon carbide paper is used to polish the measurement surface, then particle size 1 to 6 μm diamond powder dispersed in alcohol or another diluent or pure water is used to polish the surface to a mirror finish.

This is immersed in a 1.5 to 3% nitric acid-alcohol solution for 5 to 10 seconds to bring out the high angle grain boundaries. At this time, the corrosion work is performed inside an exhaust treatment apparatus. The temperature of the work atmosphere is made ordinary temperature.

The corroded sample is washed by acetone or ethyl alcohol, then allowed to dry and used for observation under a scanning electron microscope. The scanning electron microscope used is equipped with two electron detectors. In a $9.6\times10^{-5}$ or less vacuum, a sample was irradiated with electron beams at an acceleration voltage of 10 kV and level of irradiation current of 8, and a secondary electron image in a range of the ⅛ to ⅜ position about the ¼ position of sheet thickness of the sample is captured. The capture magnification is made 10000× based on a horizontal 386 mm×vertical 290 mm screen. The number of fields captured is made 10 fields or more.

In the captured secondary electron image, the crystal grain boundaries and carbides are captured as bright contrast, so the positions of the crystal grain boundaries and carbides can be used to judge the structures. If carbides are formed inside of the crystal grains, they are tempered martensite or lower bainite. Structures in which no carbides are observed inside of the crystal grains are martensite.

On the other hand, the structures with carbides formed at the crystal grain boundaries are upper bainite or pearlite.

Regarding the residual austenite, the crystal structures are different from the above microstructure, so fields the same as the positions where the secondary electron images are measured by electron backscatter diffraction method. The scanning electron microscope used is made one equipped with a camera able to be used for electron backscatter diffraction method. In a $9.6\times10^{-5}$ or less vacuum, a sample is irradiated with electron beams at an acceleration voltage of 25 kV and level of irradiation current of 16 for measurement. A face-centered cubic lattice map is prepared from the measurement data obtained.

The capture magnification is made 10000× based on a horizontal 386 mm×vertical 290 mm screen. On the photo, a 2 μm interval mesh is prepared. The microstructures positioned at the intersecting points of the mesh are selected. The value of the numbers of intersecting points of the structures divided by all of the intersecting points is made the area ratio of the microstructures. This operation is performed for 10 fields, the average value is calculated, and this is used as the area ratio of the microstructure.

Next, embodiments of the hot stamped article according to the present invention and the method for manufacture for obtaining the steel sheet for hot stamping use used for manufacture of the hot stamped article will be explained.

Method for Manufacturing Steel Sheet for Hot Stamping Use (1) Continuous Casting Step The molten steel having the above chemical composition is cast by the continuous casting method to obtain a steel slab. At this continuous casting step, the amount of casting of molten steel per unit time is preferably made 6 ton/min or less. If the amount of molten steel cast per unit time at the time of continuous casting (casting rate) is over 6 ton/min, microsegregation of Mn increases and the amount of nucleation of precipitates mainly comprised of Mo or Nb ends up increasing. Making the amount of casting 5 ton/min or less is further preferable. The lower limit of the amount of casting is not particularly prescribed, but from the viewpoint of the operating cost, 0.1 ton/min or more is preferable.

(2) Hot Rolling Step

The above-mentioned steel slab is hot rolled to obtain a steel sheet. At this time, the hot rolling is ended in the temperature region of the A3 transformation temperature defined by formula (2)+10° C. to the A3 transformation temperature+200° C., the final stage rolling reduction at that time is made 12% or more, the cooling is started within 1 second from the end of finish rolling, the cooling is performed through the temperature region from the temperature of the end of finish rolling to 550° C. by a 100° C./s or more cooling rate, and the steel is coiled at less than 500° C. temperature.

$$A3\text{ transformation temperature}=850+10\times(C+N)\times Mn+350\times Nb+250\times Ti+40\times B+10\times Cr+100\times Mo \quad \text{formula (2)}$$

By making the finish rolling temperature the A3 transformation temperature+10° C. or more, recrystallization of austenite is promoted. Due to this, low angle grain boundaries can be kept from forming in the crystal grains and precipitation sites for Nb and Mo can be decreased. Further, by decreasing the precipitation sites for Nb and Mo, consumption of C can also be suppressed, so in the later processes, the number density of the carbides can be raised. Preferably, the temperature is the A3 transformation temperature+30° C. or more.

By making the finish rolling temperature the A3 transformation temperature+200° C. or less, excessive grain growth of the austenite is suppressed. By performing the finish rolling at the A3 transformation temperature+200° C. or less temperature region, the recrystallization of austenite is promoted and in addition no excessive grain growth occurs, so in the coiling step, fine carbides can be obtained. Preferably, the temperature is the A3 transformation temperature+150° C. or less.

By making the rolling reduction of the finish rolling 12% or more, recrystallization of the austenite is promoted. Due to this, formation of low angle grain boundaries in the crystal grains can be suppressed and the precipitation sites of Nb and Mo can be decreased. Preferably the content is 15% or more.

Cooling is started within 1 second from the end of the finish rolling, preferably within 0.8 second. By cooling through the temperature region from the end temperature of finish rolling down to 550° C. by a 100° C./s or more cooling rate, it is possible to decrease the dwell time in the temperature region where precipitation of Nb and Mn is promoted. As a result, it is possible to suppress precipitation of Nb and Mo in the austenite. The amounts of solid solution of Nb and Mo at the austenite grain boundaries increase.

By making the coiling temperature less than 500° C., the above effect is raised and the concentration of Mn in the carbides is suppressed to thereby cause the formation of easy dissolvable fine carbides and, furthermore, introduce high density dislocations into the steel. Preferably the temperature is less than 480° C. The lower limit is not particularly prescribed, but coiling at room temperature or less is difficult in actual operation, so room temperature is the lower limit.

(3) Formation of Plating Layer

The surface of the steel sheet may also be formed with a plating layer for the purpose of improving the corrosion resistance etc. The plating layer may be either of an electroplating layer and hot dip coating layer. As the electroplating layer, an electrogalvanized layer, electro Zn—Ni alloy plating layer, etc. may be illustrated. As the hot dip coating layer, a hot dip galvanized layer, hot dip galvannealed layer, hot dip aluminum plating layer, hot dip Zn—Al alloy plating layer, hot dip Zn—Al—Mg alloy plating layer, hot dip Zn—Al—Mg—Si alloy plating layer, etc. may be illustrated. The amount of the plating layer deposited is not particularly limited and may be a general amount of deposition.

(4) Other Processes

In the manufacture of steel sheet for hot stamping use, in addition, pickling, cold rolling, temper rolling, or other known processes can be included.

Production Process of Hot Stamped Article

The hot stamped article of the present invention is manufactured by heating a steel sheet for hot stamping use to a 500° C. to A3 point temperature region by a 100° C./s to less than 200° C./s average heating rate and holding it there, then hot stamping it and cooling the stamped part down to room temperature.

Further, to adjust the strength, it is possible to temper part of the regions or all of the regions of the hot stamped article at a 200° C. to 500° C. temperature.

By heating and holding through the 500° C. to the A3 point temperature region by a 100° C./s to less than 200° C./s average heating rate and then hot stamping, it is possible to use both the easy to melt fine carbides and high density dislocations as nucleation sites of the prior austenite and control the average grain size of the prior austenite to 3 μm or less. Furthermore, this also contributes to suppression of segregation of NbC and MoC during heating and increase of the solid solution ratio of one or both of Nb and Mo at the grain boundaries of the prior austenite.

The average heating rate is preferably 120° C./s or more. If the average heating rate is over 200° C./s, transformation to austenite is promoted while carbides are incompletely melted and deterioration of toughness is invited, so 200° C./s is made the upper limit. Preferably, the rate is less than 180° C./s.

The holding temperature at the time of hot stamping is preferably made the A3 point+10° C. to A3 point+150° C. Further, the cooling rate after hot stamping is preferably 10° C./s or more.

EXAMPLES

Next, examples of the present invention will be explained, but the conditions in the examples are just illustrations of conditions employed for confirming the workability and advantageous effects of the present invention. The present invention is not limited to the illustration of examples. The present invention can employ various conditions so long as not departing from the gist of the present invention and achieving the object of the present invention.

Steel slabs manufactured by casting molten steel of the chemical compositions shown in Tables 1-1 to 1-3 were hot rolled and cold rolled under the conditions shown in Tables 2-1 to 2-3 to obtain steel sheets for hot stamping use. The obtained steel sheets for hot stamping use were heat treated as shown in Tables 2-1 to 2-3 and hot stamped to manufacture parts.

Tables 3-1 to 3-3 show the microstructures and mechanical properties of hot stamped articles.

TABLE 1-1

| Steel | Chemical composition/mass % | | | | | | | | | | | | | A3 | |
|---|---|---|---|---|---|---|---|---|---|---|---|---|---|---|---|
| no. | C | Si | Mn | sol. Al | Cr | B | Nb | Mo | P | S | N | Ti | Ni | (° C.) | Remarks |
| 1 | 0.28 | 0.05 | 1.1 | 0.040 | 1.00 | 0.0015 | 0.080 | 0.001 | 0.005 | 0.0020 | 0.0020 | 0.020 | 0 | 876 | Comp. ex. |
| 2 | 0.32 | 0.22 | 1.6 | 0.045 | 0.05 | 0.0005 | 0.010 | 0.002 | 0.010 | 0.0040 | 0.0040 | 0 | 0 | 839 | Comp. ex. |
| 3 | 0.30 | 0.15 | 1.3 | 0.028 | 0.87 | 0.0015 | 0.015 | 0.210 | 0.007 | 0.0093 | 0.0024 | 0.015 | 0 | 873 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | 0 | 878 | Comp. ex. |
| 5 | 0.17 | 0.02 | 0.6 | 0.088 | 0.05 | 0.0013 | 0.020 | 0.001 | 0.068 | 0.0220 | 0.0019 | 0.010 | 0 | 841 | Comp. ex. |
| 6 | 0.24 | 0.22 | 1.4 | 0.044 | 0.21 | 0.0019 | 0.016 | 0.018 | 0.015 | 0.0020 | 0.0035 | 0.023 | 0 | 869 | Inv. ex. |
| 7 | 0.33 | 0.18 | 1.5 | 0.046 | 0.42 | 0.0022 | 0.086 | 0.011 | 0.014 | 0.0006 | 0.0033 | 0.027 | 0 | 897 | Inv. ex. |
| 8 | 0.37 | 0.19 | 1.4 | 0.042 | 0.23 | 0.0023 | 0.048 | 0.013 | 0.010 | 0.0005 | 0.0037 | 0.028 | 0 | 883 | Comp. ex. |
| 9 | 0.31 | 0.001 | 1.4 | 0.045 | 0.44 | 0.0022 | 0.086 | 0.012 | 0.013 | 0.0005 | 0.0033 | 0.021 | 0 | 875 | Comp. ex. |
| 10 | 0.31 | 0.028 | 1.4 | 0.044 | 0.42 | 0.0022 | 0.087 | 0.013 | 0.012 | 0.0006 | 0.0032 | 0.023 | 0 | 876 | Inv. ex. |
| 11 | 0.32 | 0.18 | 1.6 | 0.044 | 0.43 | 0.0023 | 0.085 | 0.011 | 0.013 | 0.0006 | 0.0031 | 0 | 0 | 870 | Inv. ex. |
| 12 | 0.32 | 0.23 | 1.5 | 0.046 | 0.43 | 0.0022 | 0.087 | 0.011 | 0.012 | 0.0004 | 0.0032 | 0.022 | 0 | 876 | Inv. ex. |
| 13 | 0.32 | 0.81 | 1.6 | 0.045 | 0.42 | 0.0024 | 0.087 | 0.011 | 0.012 | 0.0004 | 0.0032 | 0.021 | 0 | 876 | Comp. ex. |
| 14 | 0.31 | 0.17 | 0.3 | 0.046 | 0.42 | 0.0024 | 0.086 | 0.011 | 0.014 | 0.0006 | 0.0031 | 0.023 | 0 | 872 | Comp. ex. |
| 15 | 0.32 | 0.19 | 0.8 | 0.046 | 0.42 | 0.0022 | 0.085 | 0.012 | 0.013 | 0.0005 | 0.0032 | 0.023 | 0 | 874 | Inv. ex. |
| 16 | 0.33 | 0.17 | 1.4 | 0.045 | 0.44 | 0.0024 | 0.087 | 0.012 | 0.013 | 0.0004 | 0.0033 | 0 | 0 | 871 | Inv. ex. |
| 17 | 0.32 | 0.18 | 2.9 | 0.045 | 0.43 | 0.0024 | 0.085 | 0.013 | 0.013 | 0.0005 | 0.0032 | 0.023 | 0 | 881 | Inv. ex. |
| 18 | 0.33 | 0.17 | 3.7 | 0.044 | 0.44 | 0.0023 | 0.087 | 0.013 | 0.014 | 0.0004 | 0.0031 | 0.021 | 0 | 884 | Comp. ex. |
| 19 | 0.32 | 0.19 | 1.6 | 0.0001 | 0.43 | 0.0023 | 0.085o | 0.011 | 0.014 | 0.0006 | 0.0032 | 0.022 | 0 | 876 | Comp. ex. |
| 20 | 0.31 | 0.19 | 1.6 | 0.0038 | 0.44 | 0.0022 | 0.087 | 0.011 | 0.013 | 0.0004 | 0.0031 | 0.022 | 0 | 877 | Inv. ex. |
| 21 | 0.31 | 0.17 | 1.4 | 0.045 | 0.42 | 0.0024 | 0.086 | 0.013 | 0.014 | 0.0005 | 0.0031 | 0 | 0 | 870 | Inv. ex. |
| 22 | 0.31 | 0.17 | 1.5 | 2.8 | 0.42 | 0.0023 | 0.087 | 0.012 | 0.013 | 0.0006 | 0.0032 | 0.021 | 0 | 876 | Inv. ex. |
| 23 | 0.32 | 0.17 | 1.4 | 3.6 | 0.44 | 0.0023 | 0.085 | 0.013 | 0.012 | 0.0006 | 0.0033 | 0.022 | 0 | 876 | Comp. ex. |
| 24 | 0.32 | 0.19 | 1.6 | 0.045 | 0.03 | 0.0023 | 0.085 | 0.013 | 0.014 | 0.0004 | 0.0032 | 0.023 | 0 | 872 | Comp. ex. |
| 25 | 0.31 | 0.18 | 1.4 | 0.045 | 0.11 | 0.0024 | 0.085 | 0.011 | 0.012 | 0.0004 | 0.0032 | 0.021 | 0 | 872 | Inv. ex. |
| 26 | 0.33 | 0.18 | 1.6 | 0.044 | 0.43 | 0.0024 | 0.086 | 0.012 | 0.014 | 0.0005 | 0.0033 | 0 | 0 | 871 | Inv. ex. |
| 27 | 0.31 | 0.17 | 1.6 | 0.045 | 0.93 | 0.0024 | 0.085 | 0.012 | 0.014 | 0.0005 | 0.0031 | 0.022 | 0 | 881 | Inv. ex. |
| 28 | 0.31 | 0.17 | 1.4 | 0.045 | 1.20 | 0.0024 | 0.087 | 0.011 | 0.013 | 0.0005 | 0.0033 | 0.023 | 0 | 884 | Comp. ex. |
| 29 | 0.32 | 0.19 | 1.6 | 0.046 | 0.44 | 0.0002 | 0.087 | 0.013 | 0.014 | 0.0004 | 0.0033 | 0.022 | 0 | 877 | Comp. ex. |
| 30 | 0.31 | 0.19 | 1.4 | 0.046 | 0.42 | 0.0007 | 0.085 | 0.013 | 0.014 | 0.0006 | 0.0031 | 0.023 | 0 | 875 | Inv. ex. |

TABLE 1-2

| Steel | Chemical composition/mass % | | | | | | | | | | | | | A3 | |
|---|---|---|---|---|---|---|---|---|---|---|---|---|---|---|---|
| no. | C | Si | Mn | sol. Al | Cr | B | Nb | Mo | P | S | N | Ti | Ni | (° C.) | Remarks |
| 31 | 0.31 | 0.18 | 1.4 | 0.045 | 0.42 | 0.0024 | 0.087 | 0.011 | 0.012 | 0.0005 | 0.0032 | 0 | 0 | 870 | Inv. ex. |
| 32 | 0.33 | 0.17 | 1.6 | 0.045 | 0.42 | 0.0081 | 0.086 | 0.013 | 0.012 | 0.0005 | 0.0033 | 0.023 | 0 | 877 | Inv. ex. |
| 33 | 0.31 | 0.19 | 1.4 | 0.044 | 0.42 | 0.0140 | 0.087 | 0.012 | 0.013 | 0.0006 | 0.0031 | 0.023 | 0 | 877 | Comp. ex. |
| 34 | 0.33 | 0.18 | 1.5 | 0.046 | 0.43 | 0.0022 | 0.008 | 0.011 | 0.013 | 0.0005 | 0.0033 | 0.021 | 0 | 849 | Comp. ex. |
| 35 | 0.31 | 0.18 | 1.5 | 0.045 | 0.42 | 0.0024 | 0.022 | 0.012 | 0.012 | 0.0005 | 0.0031 | 0.022 | 0 | 853 | Inv. ex. |
| 36 | 0.32 | 0.17 | 1.5 | 0.046 | 0.44 | 0.0022 | 0.087 | 0.011 | 0.014 | 0.0006 | 0.0031 | 0 | 0 | 871 | Inv. ex. |
| 37 | 0.33 | 0.19 | 1.6 | 0.045 | 0.42 | 0.0022 | 0.14 | 0.013 | 0.013 | 0.0004 | 0.0031 | 0.022 | 0 | 896 | Inv. ex. |
| 38 | 0.32 | 0.17 | 1.6 | 0.045 | 0.42 | 0.0024 | 0.19 | 0.011 | 0.014 | 0.0004 | 0.0033 | 0.021 | 0 | 912 | Comp. ex. |
| 39 | 0.33 | 0.19 | 1.5 | 0.045 | 0.43 | 0.0022 | 0.086 | 0.002 | 0.014 | 0.0004 | 0.0033 | 0.021 | 0 | 875 | Comp. ex. |
| 40 | 0.32 | 0.17 | 1.5 | 0.045 | 0.44 | 0.0024 | 0.086 | 0.018 | 0.014 | 0.0005 | 0.0031 | 0.022 | 0 | 877 | Inv. ex. |
| 41 | 0.31 | 0.18 | 1.4 | 0.045 | 0.43 | 0.0023 | 0.085 | 0.013 | 0.014 | 0.0006 | 0.0031 | 0 | 0 | 870 | Inv. ex. |
| 42 | 0.32 | 0.17 | 1.6 | 0.045 | 0.43 | 0.0023 | 0.086 | 0.82 | 0.013 | 0.0006 | 0.0033 | 0.021 | 0 | 957 | Inv. ex. |
| 43 | 0.33 | 0.17 | 1.6 | 0.044 | 0.43 | 0.0022 | 0.087 | 1.30 | 0.013 | 0.0005 | 0.0032 | 0.021 | 0 | 1005 | Comp. ex. |
| 44 | 0.31 | 0.19 | 1.5 | 0.046 | 0.43 | 0.0023 | 0.085 | 0.012 | 0.014 | 0.0004 | 0.0033 | 0 | 0 | 870 | Inv. ex. |
| 45 | 0.31 | 0.17 | 1.4 | 0.046 | 0.42 | 0.0022 | 0.086 | 0.012 | 0.140 | 0.0004 | 0.0032 | 0.023 | 0 | 876 | Comp. ex. |
| 46 | 0.32 | 0.19 | 1.4 | 0.044 | 0.42 | 0.0022 | 0.085 | 0.013 | 0.013 | 0.0006 | 0.0033 | 0 | 0 | 870 | Inv. ex. |
| 47 | 0.31 | 0.19 | 1.6 | 0.045 | 0.43 | 0.0023 | 0.086 | 0.013 | 0.013 | 0.14 | 0.0031 | 0.023 | 0 | 877 | Comp. ex. |
| 48 | 0.33 | 0.19 | 1.5 | 0.044 | 0.44 | 0.0024 | 0.085 | 0.012 | 0.013 | 0.0006 | 0.0031 | 0.022 | 0 | 876 | Inv. ex. |
| 49 | 0.31 | 0.17 | 1.5 | 0.045 | 0.43 | 0.0022 | 0.087 | 0.013 | 0.012 | 0.0004 | 0.021 | 0.021 | 0 | 876 | Comp. ex. |
| 50 | 0.32 | 0.18 | 1.4 | 0.044 | 0.43 | 0.0022 | 0.086 | 0.011 | 0.012 | 0.0005 | 0.0032 | 0.080 | 0 | 890 | Inv. ex. |
| 51 | 0.33 | 0.17 | 1.4 | 0.044 | 0.44 | 0.0023 | 0.087 | 0.011 | 0.013 | 0.0005 | 0.0032 | 0 | 0.4 | 871 | Inv. ex. |
| 4 | 0.30 | 0.24 | 1.5 | 0.040 | 0.20 | 0.0050 | 0.080 | 0.005 | 0.011 | 0.0020 | 0.0041 | 0.050 | 0 | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | 0 | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | 0 | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | 0 | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | 0 | 878 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |

TABLE 1-3

| Steel | Chemical composition/mass % | | | | | | | | | | | | | A3 | |
|---|---|---|---|---|---|---|---|---|---|---|---|---|---|---|---|
| no. | C | Si | Mn | sol. Al | Cr | B | Nb | Mo | P | S | N | Ti | Ni | (° C.) | Remarks |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Comp. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |
| 8 | 0.33 | 0.18 | 1.5 | 0.046 | 0.42 | 0.0022 | 0.086 | 0.011 | 0.014 | 0.0006 | 0.0033 | 0.027 | 0 | 877 | Inv. ex. |

TABLE 2-1

| | | Continuous casting step | Hot rolling step | | | | | Cold | Plating | | |
|---|---|---|---|---|---|---|---|---|---|---|---|
| Steel no. | Manufacturing no. | Amount of casting of molten steel (ton/min) | Finish rolling temp. (° C.) | Finish rolling rate (%) | Cooling start time (sec) | Cooling rate (° C./s) | Coiling start temp. (° C.) | rolling (%) Cold rolling reduction (%) | Plating | Alloying after plating | Remarks |
| 1 | 1 | 4.5 | 904 | 18 | 0.9 | 131 | 519 | 56 | None | None | Comp. ex. |
| 2 | 2 | 8.2 | 853 | 17 | 0.9 | 121 | 456 | 69 | None | None | Comp. ex. |
| 3 | 3 | 2.6 | 904 | 17 | 0.8 | 125 | 561 | 57 | None | None | Comp. ex. |
| 4 | 4 | 7.1 | 908 | 17 | 0.8 | 131 | 482 | 57 | None | None | Comp. ex. |
| 5 | 5 | 8.2 | 908 | 19 | 0.8 | 213 | 635 | 59 | None | None | Comp. ex. |
| 6 | 6 | 4.8 | 915 | 17 | 0.8 | 131 | 485 | 56 | None | None | Inv. ex. |
| 7 | 7 | 4.8 | 905 | 19 | 0.8 | 133 | 477 | 59 | None | None | Inv. ex. |
| 8 | 8 | 4.4 | 908 | 18 | 0.8 | 121 | 473 | 59 | None | None | Comp. ex. |
| 9 | 9 | 4.7 | 915 | 17 | 0.8 | 128 | 472 | 57 | None | None | Comp. ex. |
| 10 | 10 | 4.5 | 907 | 19 | 0.9 | 131 | 476 | 59 | None | None | Inv. ex. |
| 11 | 11 | 5.1 | 911 | 16 | 0.9 | 125 | 473 | 59 | None | None | Inv. ex. |
| 12 | 12 | 4.4 | 906 | 17 | 0.8 | 133 | 471 | 57 | None | None | Inv. ex. |
| 13 | 13 | 5.3 | 905 | 19 | 0.9 | 134 | 475 | 56 | None | None | Comp. ex. |
| 14 | 14 | 5.2 | 902 | 19 | 0.8 | 126 | 479 | 59 | None | None | Comp. ex. |
| 15 | 15 | 4.7 | 902 | 16 | 0.8 | 125 | 485 | 56 | None | None | Inv. ex. |
| 16 | 16 | 4.9 | 911 | 19 | 0.8 | 130 | 479 | 59 | None | None | Inv. ex. |
| 17 | 17 | 5 | 911 | 18 | 0.8 | 128 | 471 | 56 | None | None | Inv. ex. |
| 18 | 18 | 4.6 | 909 | 17 | 0.9 | 124 | 482 | 58 | None | None | Comp. ex. |
| 19 | 19 | 5.1 | 905 | 16 | 0.8 | 123 | 480 | 56 | None | None | Comp. ex. |
| 20 | 20 | 5.1 | 907 | 16 | 0.9 | 131 | 481 | 59 | None | None | Inv. ex. |
| 21 | 21 | 5.2 | 909 | 16 | 0.8 | 131 | 475 | 57 | None | None | Inv. ex. |
| 22 | 22 | 4.7 | 913 | 17 | 0.8 | 130 | 474 | 59 | None | None | Inv. ex. |
| 23 | 23 | 5.3 | 915 | 17 | 0.9 | 123 | 481 | 56 | None | None | Comp. ex. |
| 24 | 24 | 4.8 | 910 | 19 | 0.8 | 125 | 483 | 56 | None | None | Comp. ex. |
| 25 | 25 | 5.4 | 908 | 16 | 0.8 | 126 | 480 | 57 | None | None | Inv. ex. |
| 26 | 26 | 5.1 | 903 | 19 | 0.9 | 132 | 480 | 57 | None | None | Inv. ex. |

TABLE 2-1-continued

| Steel no. | Manufacturing no. | Continuous casting step: Amount of casting of molten steel (ton/min) | Hot rolling step: Finish rolling temp. (° C.) | Finish rolling rate (%) | Cooling start time (sec) | Cooling rate (° C./s) | Coiling start temp. (° C.) | Cold rolling (%): Cold rolling reduction (%) | Plating: Plating | Alloying after plating | Remarks |
|---|---|---|---|---|---|---|---|---|---|---|---|
| 27 | 27 | 5 | 908 | 18 | 0.9 | 121 | 480 | 57 | None | None | Inv. ex. |
| 28 | 28 | 5 | 902 | 16 | 0.8 | 125 | 476 | 57 | None | None | Comp. ex. |
| 29 | 29 | 4.7 | 915 | 19 | 0.8 | 122 | 485 | 58 | None | None | Comp. ex. |
| 30 | 30 | 4.6 | 906 | 18 | 0.9 | 130 | 473 | 58 | None | None | Inv. ex. |

TABLE 2-2

| Steel no. | Manufacturing no. | Continuous casting step: Amount of casting of molten steel (ton/min) | Hot rolling step: Finish rolling temp. (° C.) | Finish rolling rate (%) | Cooling start time (sec) | Cooling rate (° C./s) | Coiling start temp. (° C.) | Cold rolling (%): Cold rolling reduction (%) | Plating: Plating | Alloying after plating | Remarks |
|---|---|---|---|---|---|---|---|---|---|---|---|
| 31 | 31 | 5.5 | 902 | 18 | 0.8 | 129 | 478 | 59 | None | None | Inv. ex. |
| 32 | 32 | 4.2 | 909 | 18 | 0.8 | 126 | 478 | 58 | None | None | Inv. ex. |
| 33 | 33 | 5.3 | 908 | 16 | 0.9 | 127 | 480 | 56 | None | None | Comp. ex. |
| 34 | 34 | 4.8 | 908 | 17 | 0.9 | 129 | 484 | 56 | None | None | Comp. ex. |
| 35 | 35 | 5.2 | 910 | 18 | 0.9 | 134 | 480 | 57 | None | None | Inv. ex. |
| 36 | 36 | 5 | 903 | 18 | 0.9 | 130 | 480 | 57 | None | None | Inv. ex. |
| 37 | 37 | 4.7 | 910 | 19 | 0.9 | 134 | 474 | 57 | None | None | Inv. ex. |
| 38 | 38 | 4.6 | 948 | 16 | 0.8 | 127 | 480 | 58 | None | None | Comp. ex. |
| 39 | 39 | 5 | 911 | 19 | 0.9 | 133 | 471 | 59 | None | None | Comp. ex. |
| 40 | 40 | 4.5 | 913 | 16 | 0.9 | 126 | 485 | 57 | None | None | Inv. ex. |
| 41 | 41 | 5.2 | 911 | 18 | 0.9 | 123 | 475 | 59 | None | None | Inv. ex. |
| 42 | 42 | 5.3 | 906 | 19 | 0.8 | 124 | 472 | 59 | None | None | Inv. ex. |
| 43 | 43 | 5 | 903 | 16 | 0.8 | 135 | 473 | 59 | None | None | Comp. ex. |
| 44 | 44 | 4.4 | 905 | 17 | 0.9 | 121 | 483 | 58 | None | None | Inv. ex. |
| 45 | 45 | 5.2 | 908 | 17 | 0.9 | 123 | 485 | 58 | None | None | Comp. ex. |
| 46 | 46 | 4.7 | 912 | 18 | 0.8 | 130 | 482 | 58 | None | None | Inv. ex. |
| 47 | 47 | 5 | 914 | 17 | 0.8 | 135 | 484 | 59 | None | None | Comp. ex. |
| 48 | 48 | 4.4 | 915 | 17 | 0.9 | 127 | 471 | 57 | None | None | Inv. ex. |
| 49 | 49 | 4.7 | 901 | 17 | 0.8 | 126 | 475 | 59 | None | None | Comp. ex. |
| 50 | 50 | 4.2 | 902 | 16 | 0.8 | 126 | 480 | 58 | None | None | Inv. ex. |
| 51 | 51 | 5.5 | 903 | 17 | 0.9 | 132 | 477 | 59 | None | None | Inv. ex. |
| 4 | 52 | 5 | 870 | 18 | 0.8 | 126 | 495 | 58 | None | None | Comp. ex. |
| 4 | 53 | 5 | 908 | 10 | 0.8 | 124 | 485 | 58 | None | None | Comp. ex. |
| 4 | 54 | 5 | 908 | 18 | 1.1 | 125 | 477 | 58 | None | None | Comp. ex. |
| 4 | 55 | 5 | 908 | 18 | 0.8 | 124 | 478 | 58 | None | None | Comp. ex. |
| 4 | 56 | 5 | 908 | 18 | 0.8 | 122 | 475 | 58 | None | None | Inv. ex. |
| 8 | 57 | 3.7 | 912 | 17 | 0.8 | 127 | 477 | 56 | None | None | Inv. ex. |
| 8 | 58 | 5.5 | 912 | 16 | 0.8 | 132 | 482 | 59 | None | None | Inv. ex. |
| 8 | 59 | 8.1 | 903 | 16 | 0.8 | 123 | 483 | 58 | None | None | Comp. ex. |
| 8 | 60 | 4.9 | 880 | 18 | 0.8 | 127 | 471 | 56 | None | None | Comp. ex. |

TABLE 2-3

| Steel no. | Manufacturing no. | Continuous casting step: Amount of casting of molten steel (ton/min) | Hot rolling step: Finish rolling temp. (° C.) | Finish rolling rate (%) | Cooling start time (sec) | Cooling rate (° C./s) | Coiling start temp. (° C.) | Cold rolling (%): Cold rolling reduction (%) | Plating: Plating | Alloying after plating | Remarks |
|---|---|---|---|---|---|---|---|---|---|---|---|
| 8 | 61 | 5.2 | 911 | 18 | 0.9 | 129 | 479 | 58 | None | None | Inv. ex. |
| 8 | 62 | 5.3 | 942 | 19 | 0.9 | 123 | 478 | 59 | None | None | Inv. ex. |
| 8 | 63 | 4.6 | 1005 | 18 | 0.9 | 126 | 474 | 56 | None | None | Inv. ex. |
| 8 | 64 | 5.1 | 1150 | 19 | 0.9 | 124 | 471 | 57 | None | None | Comp. ex. |

TABLE 2-3-continued

| Steel no. | Manufacturing no. | Continuous casting step: Amount of casting of molten steel (ton/min) | Hot rolling step: Finish rolling temp. (° C.) | Finish rolling rate (%) | Cooling start time (sec) | Cooling rate (° C./s) | Coiling start temp. (° C.) | Cold rolling (%): Cold rolling reduction (%) | Plating: Plating | Alloying after plating | Remarks |
|---|---|---|---|---|---|---|---|---|---|---|---|
| 8 | 65 | 5.6 | 908 | 9 | 0.8 | 121 | 478 | 59 | None | None | Comp. ex. |
| 8 | 66 | 4.9 | 901 | 13 | 0.8 | 132 | 477 | 56 | None | None | Inv. ex. |
| 8 | 67 | 5 | 901 | 15 | 0.8 | 122 | 477 | 58 | None | None | Inv. ex. |
| 8 | 68 | 4.9 | 914 | 18 | 0.8 | 121 | 478 | 56 | None | None | Inv. ex. |
| 8 | 69 | 5.4 | 912 | 17 | 0.9 | 129 | 478 | 58 | None | None | Inv. ex. |
| 8 | 70 | 5.2 | 915 | 17 | 1.9 | 134 | 481 | 56 | None | None | Comp. ex. |
| 8 | 71 | 4.9 | 903 | 16 | 0.8 | 85 | 478 | 57 | None | None | Comp. ex. |
| 8 | 72 | 5.3 | 911 | 17 | 0.8 | 110 | 476 | 56 | None | None | Inv. ex. |
| 8 | 73 | 4.9 | 913 | 19 | 0.8 | 120 | 477 | 56 | None | None | Inv. ex. |
| 8 | 74 | 4.9 | 905 | 19 | 0.9 | 122 | 55 | 57 | None | None | Inv. ex. |
| 8 | 75 | 4.9 | 903 | 16 | 0.9 | 132 | 470 | 59 | None | None | Inv. ex. |
| 8 | 76 | 5.4 | 914 | 17 | 0.8 | 125 | 485 | 58 | None | None | Inv. ex. |
| 8 | 77 | 5.4 | 908 | 18 | 0.9 | 121 | 540 | 59 | None | None | Comp. ex. |
| 8 | 78 | 4.9 | 905 | 16 | 0.8 | 121 | 476 | 0 | None | None | Inv. ex. |
| 8 | 79 | 4.4 | 904 | 19 | 0.9 | 121 | 480 | 56 | Yes | None | Inv. ex. |
| 8 | 80 | 4.6 | 908 | 18 | 0.9 | 134 | 482 | 56 | Yes | Yes | Inv. ex. |
| 8 | 81 | 5 | 907 | 19 | 0.9 | 121 | 476 | 59 | None | None | Inv. ex. |
| 8 | 82 | 4.5 | 905 | 17 | 0.9 | 121 | 484 | 56 | None | None | Comp. ex. |
| 8 | 83 | 4.8 | 909 | 17 | 0.9 | 135 | 484 | 57 | None | None | Inv. ex. |
| 8 | 84 | 4.6 | 904 | 18 | 0.8 | 135 | 474 | 57 | None | None | Inv. ex. |
| 8 | 85 | 4.4 | 909 | 17 | 0.9 | 129 | 479 | 56 | None | None | Inv. ex. |
| 8 | 86 | 4.8 | 908 | 18 | 0.9 | 131 | 481 | 59 | None | None | Comp. ex. |
| 8 | 87 | 4.9 | 909 | 16 | 0.9 | 121 | 475 | 59 | None | None | Inv. ex. |
| 8 | 88 | 4.9 | 909 | 16 | 0.9 | 125 | 481 | 59 | None | None | Inv. ex. |

TABLE 3-1

| Steel no. | Manufacturing no. | Heat treatment step: Heating rate (° C./s) | Heating temp. (° C.) | Cooling rate (° C.) | Tempering temp. (° C.) | Metal structure of hot stamped article: Average grain size of prior austenite (μm) | Area ratio of lower bainite or martensite or tempered martensite (%) | Type of structure | Grain boundary solid solution ratio Z | Mechanical properties: Tensile strength (MPa) | Brittle fracture ratio at minus 100° C. (%) | Remarks |
|---|---|---|---|---|---|---|---|---|---|---|---|---|
| 1 | 1 | 160 | 880 | 55 | | 3 | 95 | Martensite | 0.1 | 1990 | 56 | Comp. ex. |
| 2 | 2 | 90 | 839 | 60 | | 7 | 100 | Martensite | 0.2 | 1860 | 52 | Comp. ex. |
| 3 | 3 | 10 | 880 | 58 | | 5.6 | 100 | Martensite | 0.2 | 1850 | 53 | Comp. ex. |
| 4 | 4 | 168 | 900 | 55 | | 3.1 | 100 | Martensite | 0.2 | 1905 | 52 | Comp. ex. |
| 5 | 5 | 174 | 900 | 61 | | 2.7 | 100 | Martensite | 0.2 | 1270 | 43 | Comp. ex. |
| 6 | 6 | 178 | 915 | 60 | | 3 | 95 | Martensite | 0.5 | 1586 | 13 | Inv. ex. |
| 7 | 7 | 169 | 915 | 59 | | 2.3 | 99 | Martensite | 0.4 | 1854 | 27 | Inv. ex. |
| 8 | 8 | 166 | 915 | 66 | | 2.4 | 98 | Martensite | 0.3 | 2121 | 57 | Comp. ex. |
| 9 | 9 | 177 | 915 | 66 | | 2.2 | 97 | Martensite | 0.4 | Early fracture | Early fracture | Comp. ex. |
| 10 | 10 | 164 | 915 | 56 | | 2.3 | 97 | Martensite | 0.4 | 1843 | 28 | Inv. ex. |
| 11 | 11 | 176 | 915 | 58 | | 2.6 | 99 | Martensite | 0.4 | 1844 | 12 | Inv. ex. |
| 12 | 12 | 174 | 915 | 65 | | 3 | 97 | Martensite | 0.4 | 1848 | 27 | Inv. ex. |
| 13 | 13 | 162 | 915 | 68 | | 4.9 | 97 | Martensite | 0.4 | 1841 | 47 | Comp. ex. |
| 14 | 14 | 172 | 915 | 60 | | 2.4 | 62 | Martensite | 0.5 | 1273 | 6 | Comp. ex. |
| 15 | 15 | 178 | 915 | 67 | | 2.5 | 97 | Martensite | 0.4 | 1850 | 26 | Inv. ex. |
| 16 | 16 | 174 | 915 | 68 | | 2.4 | 99 | Martensite | 0.4 | 1903 | 13 | Inv. ex. |
| 17 | 17 | 164 | 915 | 62 | | 2.3 | 97 | Martensite | 0.4 | 1963 | 27 | Inv. ex. |
| 18 | 18 | 167 | 915 | 63 | | 4.8 | 97 | Martensite | 0.4 | 1990 | 47 | Comp. ex. |
| 19 | 19 | 178 | 915 | 56 | | 2.6 | 98 | Martensite | 0.4 | Early fracture | Early fracture | Comp. ex. |
| 20 | 20 | 175 | 915 | 65 | | 2.6 | 99 | Martensite | 0.4 | 1851 | 28 | Inv. ex. |
| 21 | 21 | 170 | 915 | 59 | | 2.2 | 97 | Martensite | 0.4 | 1848 | 12 | Inv. ex. |
| 22 | 22 | 162 | 915 | 70 | | 2.4 | 99 | Martensite | 0.4 | 1855 | 26 | Inv. ex. |
| 23 | 23 | 175 | 915 | 56 | | 2.6 | 97 | Martensite | 0.4 | Early fracture | Early fracture | Comp. ex. |
| 24 | 24 | 178 | 915 | 66 | | 2.6 | 63 | Martensite | 0.5 | 1277 | 7 | Comp. ex. |
| 25 | 25 | 170 | 915 | 69 | | 2.5 | 99 | Martensite | 0.4 | 1842 | 28 | Inv. ex. |
| 26 | 26 | 171 | 915 | 66 | | 3 | 98 | Martensite | 0.4 | 1905 | 13 | Inv. ex. |

TABLE 3-1-continued

| | | Heat treatment step | | | | Metal structure of hot stamped article | | | | Mechanical properties | | |
|---|---|---|---|---|---|---|---|---|---|---|---|---|
| Steel no. | Manu-facturing no. | Heating rate (° C./s) | Heating temp. (° C.) | Cooling rate (° C.) | Tempering temp. (° C.) | Average grain size of prior austenite (μm) | Area ratio of lower bainite or martensite or tempered martensite (%) | Type of structure | Grain boundary solid solution ratio Z | Tensile strength (MPa) | Brittle fracture ratio at minus 100° C. (%) | Remarks |
| 27 | 27 | 163 | 915 | 61 | | 2.9 | 98 | Martensite | 0.4 | 1953 | 28 | Inv. ex. |
| 28 | 28 | 180 | 915 | 65 | | 5 | 99 | Martensite | 0.4 | 1853 | 47 | Comp. ex. |
| 29 | 29 | 165 | 915 | 65 | | 2.3 | 64 | Martensite | 0.5 | 1274 | 7 | Comp. ex. |
| 30 | 30 | 161 | 915 | 70 | | 2.6 | 99 | Martensite | 0.4 | 1847 | 28 | Inv. ex. |

TABLE 3-2

| | | Heat treatment step | | | | Metal structure of hot stamped article | | | | Mechanical properties | | |
|---|---|---|---|---|---|---|---|---|---|---|---|---|
| Steel no. | Manu-facturing no. | Heating rate (° C./s) | Heating temp. (° C.) | Cooling rate (° C.) | Tempering temp. (° C.) | Average grain size of prior austenite (μm) | Area ratio of lower bainite or martensite or tempered martensite (%) | Type of structure | Grain boundary solid solution ratio Z | Tensile strength (MPa) | Brittle fracture ratio at minus 100° C. (%) | Remarks |
| 31 | 31 | 169 | 915 | 61 | | 3 | 99 | Martensite | 0.4 | 1913 | 12 | Inv. ex. |
| 32 | 32 | 163 | 915 | 65 | | 2.8 | 99 | Martensite | 0.4 | 1952 | 26 | Inv. ex. |
| 33 | 33 | 170 | 915 | 59 | | 4.9 | 97 | Martensite | 0.4 | 1843 | 48 | Comp. ex. |
| 34 | 34 | 174 | 915 | 70 | | 2.6 | 98 | Martensite | 0.1 | 1843 | 58 | Comp. ex. |
| 35 | 35 | 177 | 915 | 59 | | 2.5 | 99 | Martensite | 0.4 | 1848 | 26 | Inv. ex. |
| 36 | 36 | 172 | 915 | 64 | | 2.3 | 97 | Martensite | 0.5 | 1851 | 11 | Inv. ex. |
| 37 | 37 | 171 | 915 | 62 | | 2.2 | 98 | Martensite | 0.6 | 1842 | 27 | Inv. ex. |
| 38 | 38 | 162 | 915 | 65 | | 2.6 | 98 | Martensite | 0.2 | 1849 | 47 | Comp. ex. |
| 39 | 39 | 167 | 915 | 62 | | 2.2 | 97 | Martensite | 0.1 | 1851 | 58 | Comp. ex. |
| 40 | 40 | 166 | 915 | 58 | | 2.3 | 97 | Martensite | 0.4 | 1847 | 26 | Inv. ex. |
| 41 | 41 | 173 | 915 | 62 | | 2.4 | 98 | Martensite | 0.5 | 1842 | 11 | Inv. ex. |
| 42 | 42 | 173 | 915 | 65 | | 2.3 | 97 | Martensite | 0.6 | 1845 | 26 | Inv. ex. |
| 43 | 43 | 164 | 915 | 70 | | 2.2 | 97 | Martensite | 0.2 | 1852 | 46 | Comp. ex. |
| 44 | 44 | 177 | 915 | 63 | | 2.2 | 97 | Martensite | 0.4 | 1846 | 27 | Inv. ex. |
| 45 | 45 | 169 | 915 | 64 | | 2.3 | 98 | Martensite | 0.4 | Early fracture | Early fracture | Comp. ex. |
| 46 | 46 | 164 | 915 | 63 | | 2.3 | 99 | Martensite | 0.4 | 1854 | 26 | Inv. ex. |
| 47 | 47 | 166 | 915 | 62 | | 2.2 | 99 | Martensite | 0.4 | Early fracture | Early fracture | Comp. ex. |
| 48 | 48 | 170 | 915 | 58 | | 2.4 | 97 | Martensite | 0.4 | 1853 | 27 | Inv. ex. |
| 49 | 49 | 169 | 915 | 58 | | 2.6 | 97 | Martensite | 0.4 | Early fracture | Early fracture | Comp. ex. |
| 50 | 50 | 175 | 915 | 64 | | 2.3 | 97 | Martensite | 0.4 | 1964 | 27 | Inv. ex. |
| 51 | 51 | 164 | 915 | 68 | | 2.3 | 97 | Martensite | 0.4 | 1964 | 26 | Inv. ex. |
| 4 | 52 | 145 | 900 | 63 | | 2.7 | 98 | Martensite | 0.2 | 1905 | 47 | Comp. ex. |
| 4 | 53 | 165 | 900 | 60 | | 2.7 | 98 | Martensite | 0.2 | 1905 | 52 | Comp. ex. |
| 4 | 54 | 165 | 900 | 60 | | 2.7 | 98 | Martensite | 0.2 | 1905 | 45 | Comp. ex. |
| 4 | 55 | 90 | 900 | 60 | | 4.1 | 98 | Martensite | 0.2 | 1905 | 52 | Comp. ex. |
| 4 | 56 | 165 | 900 | 60 | | 2.7 | 98 | Martensite | 0.4 | 2050 | 28 | Inv. ex. |
| 8 | 57 | 177 | 915 | 59 | | 2.2 | 98 | Martensite | 0.4 | 1842 | 27 | Inv. ex. |
| 8 | 58 | 180 | 915 | 67 | | 2.9 | 99 | Martensite | 0.3 | 1963 | 28 | Inv. ex. |
| 8 | 59 | 177 | 915 | 68 | | 4.6 | 98 | Martensite | 0.1 | 1845 | 56 | Comp. ex. |
| 8 | 60 | 179 | 915 | 61 | | 2.5 | 97 | Martensite | 0.1 | 1852 | 46 | Comp. ex. |

TABLE 3-3

| | | Heat treatment step | | | | Metal structure of hot stamped article | | | | Mechanical properties | | |
|---|---|---|---|---|---|---|---|---|---|---|---|---|
| Steel no. | Manufacturing no. | Heating rate (° C./s) | Heating temp. (° C.) | Cooling rate (° C.) | Tempering temp. (° C.) | Average grain size of prior austenite (μm) | Area ratio of lower bainite or martensite or tempered martensite (%) | Type of structure | Grain boundary solid solution ratio Z | Tensile strength (MPa) | Brittle fracture ratio at minus 100° C. (%) | Remarks |
| 8 | 61 | 163 | 915 | 63 | | 2.5 | 97 | Martensite | 0.3 | 1847 | 27 | Inv. ex. |
| 8 | 62 | 166 | 915 | 57 | | 2.5 | 99 | Martensite | 0.4 | 1847 | 26 | Inv. ex. |
| 8 | 63 | 179 | 915 | 66 | | 2.9 | 97 | Martensite | 0.4 | 1841 | 28 | Inv. ex. |
| 8 | 64 | 178 | 915 | 68 | | 4.6 | 99 | Martensite | 0.4 | 1845 | 55 | Comp. ex. |
| 8 | 65 | 177 | 915 | 57 | | 2.3 | 99 | Martensite | 0.1 | 1855 | 48 | Comp. ex. |
| 8 | 66 | 161 | 915 | 65 | | 2.3 | 97 | Martensite | 0.3 | 1854 | 27 | Inv. ex. |
| 8 | 67 | 172 | 915 | 60 | | 2.2 | 97 | Martensite | 0.4 | 1843 | 27 | Inv. ex. |
| 8 | 68 | 170 | 915 | 58 | | 2.4 | 99 | Martensite | 0.4 | 1852 | 25 | Inv. ex. |
| 8 | 69 | 164 | 915 | 60 | | 2.6 | 97 | Martensite | 0.3 | 1842 | 28 | Inv. ex. |
| 8 | 70 | 167 | 915 | 59 | | 2.2 | 97 | Martensite | 0.1 | 1845 | 44 | Comp. ex. |
| 8 | 71 | 161 | 915 | 68 | | 2.3 | 99 | Martensite | 0.1 | 1846 | 47 | Comp. ex. |
| 8 | 72 | 174 | 915 | 59 | | 2.5 | 97 | Martensite | 0.3 | 1854 | 28 | Inv. ex. |
| 8 | 73 | 171 | 915 | 57 | | 2.4 | 97 | Martensite | 0.4 | 1843 | 27 | Inv. ex. |
| 8 | 74 | 175 | 915 | 56 | | 2.3 | 99 | Martensite | 0.4 | 1843 | 12 | Inv. ex. |
| 8 | 75 | 161 | 915 | 62 | | 2.4 | 97 | Martensite | 0.4 | 1842 | 26 | Inv. ex. |
| 8 | 76 | 175 | 915 | 56 | | 3 | 99 | Martensite | 0.4 | 1849 | 26 | Inv. ex. |
| 8 | 77 | 178 | 915 | 57 | | 5 | 99 | Martensite | 0.4 | 1845 | 61 | Comp. ex. |
| 8 | 78 | 175 | 915 | 66 | | 2.3 | 97 | Martensite | 0.4 | 1846 | 28 | Inv. ex. |
| 8 | 79 | 161 | 915 | 63 | | 2.2 | 99 | Martensite | 0.4 | 1848 | 28 | Inv. ex. |
| 8 | 80 | 179 | 915 | 63 | | 2.4 | 98 | Martensite | 0.4 | 1853 | 26 | Inv. ex. |
| 8 | 81 | 166 | 915 | 66 | 395 | 2.6 | 98 | Tempered martensite | 0.4 | 1593 | 8 | Inv. ex. |
| 8 | 82 | 94 | 915 | 62 | | 4.5 | 98 | Martensite | 0.1 | 1843 | 58 | Comp. ex. |
| 8 | 83 | 111 | 915 | 59 | | 2.8 | 98 | Martensite | 0.3 | 1852 | 27 | Inv. ex. |
| 8 | 84 | 162 | 915 | 63 | | 2.6 | 97 | Martensite | 0.4 | 1845 | 22 | Inv. ex. |
| 8 | 85 | 193 | 915 | 62 | | 2.1 | 97 | Martensite | 0.5 | 1850 | 12 | Inv. ex. |
| 8 | 86 | 231 | 915 | 68 | | 2.3 | 98 | Martensite | 0.5 | Early fracture | Early fracture | Comp. ex. |
| 8 | 87 | 173 | 915 | 62 | | 2.4 | 98 | Martensite | 0.4 | 1849 | 22 | Inv. ex. |
| 8 | 88 | 169 | 915 | 63 | | 2.6 | 97 | Martensite | 0.4 | 1842 | 22 | Inv. ex. |

Further, the tensile strength of each hot stamped article was measured by preparing a No. 5 test piece described in JIS Z 2201 and following the test method described in JIS Z 2241. As an indicator of the shock absorption, the toughness was evaluated by a Charpy impact test. A subsize Charpy impact test was performed at −100° C. A case of a brittle fracture ratio of less than 30% was deemed passing.

The hot stamped article of the present invention could be confirmed to have excellent properties of a tensile strength of 1500 MPa or more and brittle fracture ratio, an indicator of toughness, of less than 30%. On the other hand, in examples where the chemical composition and method of manufacture were not suitable, the targeted properties could not be obtained.

The invention claimed is:

1. A hot stamped article, a chemical composition of the hot stamped article comprising, by mass %, C: 0.15% to less than 0.35%, Si: 0.005% to 0.25%, Mn: 0.5% to 3.0%, sol. Al: 0.0002% to 3.0%, Cr: 0.05% to 1.00%, B: 0.0005% to 0.010%, Nb: 0.01% to 0.15%, Mo: 0.005% to 1.00%, Ti: 0% to 0.15%, Ni: 0% to 3.00%, P: 0.10% or less, S: 0.10% or less, N: 0.010% or less, and a balance of Fe and unavoidable impurities, a microstructure of the hot stamped article comprising prior austenite having an average grain size of 3 μm or less and further containing at least one of lower bainite, martensite, and tempered martensite in an area ratio of 90% or more, and a grain boundary solid solution ratio Z defined by Z=(mass % of Nb and Mo at boundaries between prior austenite grains)/(mass % of Nb and Mo in the hot stamped article) being 0.3 or more, and a brittle fracture ratio determined by a subsize Charpy impact test at −100° C. being less than 30%.

2. The hot stamped article according to claim 1, wherein the hot stamped article comprises a plating layer.

* * * * *